United States Patent [19]

Hanna

[11] Patent Number: 4,846,476

[45] Date of Patent: Jul. 11, 1989

[54] LOTTERY TYPE MACHINE

[75] Inventor: George Hanna, Forest Hills, N.Y.

[73] Assignee: H & Y Enterprises, Forest Hills, N.Y.

[21] Appl. No.: 208,741

[22] Filed: Jun. 20, 1988

[51] Int. Cl.[4] ..... A63F 9/00

[52] U.S. Cl. ..... 273/144 A

[58] Field of Search ..... 273/144 R, 144 A, 144 B

[56] References Cited

U.S. PATENT DOCUMENTS

| | | | |
|---|---|---|---|
| 2,003,979 | 6/1935 | Skoric | 273/144 A |
| 2,490,144 | 12/1949 | Masten | 273/144 A |
| 2,669,456 | 2/1954 | Hickey | 273/144 A |

*Primary Examiner*—Anton O. Oechsle

*Attorney, Agent, or Firm*—Thomas H. Whaley

[57] ABSTRACT

A machine for mixing a plurality of balls of uniform size and sequentially dispensing the balls in random order wherein the balls are mixed in a closed mixing compartment by counter-rotating disks provided with circumferentially spaced agitator elements ensuring thorough mixing of the balls, and are dispensed from the bottom portion of the mixing compartment through an outlet capable of permitting passage therethrough of only one ball at a time.

11 Claims, 2 Drawing Sheets

1
19
20
21
22
3
42
27
5
4
17
18
11
14
31
35
13
12
15
28
37
29
24
23
25
44
20'
2
8

LOTTERY TYPE MACHINE

BACKGROUND OF THE INVENTION

This invention relates to a lottery-types machine in which a plurality of balls with varied indicia are mixed and from which the balls are randomly discharged one at a time.

Many machines have been proposed for conducting lottery games but none has become broadly popular. It is believed that prior proposals lacked visual appeal and failed to stimulate excitement, both of which features are essential to the enjoyment of a game of chance.

A principal object of this invention is to provide a lottery-type machine which is visually attractive and stimulates interest and excitement.

A further object is to provide a machine in which indicia marked balls are thoroughly mixed and from which the balls are randomly discharged one at a time.

These and other features and advantages of the invention will be apparent from the description which follows.

SUMMARY OF THE INVENTION

In accordance with this invention, a lottery-type machine comprises a mixing compartment in which the balls are mixed mechanically by a pair of vertical counter-rotating disks provided with agitator elements moving the balls in opposite directions within the mixing compartment. A separate compartment contains an electric motor and a gear thin train which transmits the rotary power of the motor to two concentric shafts that extend from the motor compartment through an opening into the mixing compartment. The gear train is arranged to rotate the concentric shafts in opposite directions. A first disk is mounted to rotate with the inner shaft and a second disk is mounted to rotate in a reverse direction with the outer shaft. Circumferentially spaced agitator elements are attached to the opposed faces of the first and second disks.

A hopper for balls with varied indicia is attached to the housing cover of the mixing compartment. An opening for the passage of balls from the hopper to the mixing compartment is provided with a movable slide or other means for preventing and permitting, as desired, the discharges of the balls from the hopper into the mixing compartment.

The bottom of the mixing compartment is provided with an outlet opening dimensioned to admit loosely a single ball when a movable slide is withdrawn from the opening to permit a ball to fall therethrough. The ball discharged through the opening falls into a receptacle, usually a chute.

While the housing may be made of various materials, plastics are a preferred class of materials because many are transparent, inexpensive and easily fabricated. For example, the housing or parts thereof can be formed by injection molding. In the preferred embodiment, the mixing compartment is made of a transparent material, e.g., glass or clear plastic. Preferably, at least the first disk also is transparent. The selected transparent material, which is also desirably used for the hopper, may be lightly tinted to enhance the attractiveness of the machine. The second disk may be transparent or opaque. Preferably, the portion of the housing which forms the motor compartment and the partition are made of opaque materials that include pigmented or coated plastics.

The balls may be all of one color or they may have various colors and the indicia on the balls may be a series of numerals or letters of an alphabet. For some games the balls are marked with indicia corresponding to those of a deck of playing cards.

The electric motor may be of the type operable on house current but to make the lottery machine operative in different places including outdoors, the motor is preferably battery-powered. In either case, while the motor is enclosed in the motor compartment of the housing, the on-off switch is outside usually mounted on the surface of the housing.

BRIEF DESCRIPTION OF THE DRAWINGS

To facilitate the further description and understanding of the invention, reference will be made to the accompanying drawings of which.

DESCRIPTION OF PREFERRED EMBODIMENT

Figures 1, 2, 3:
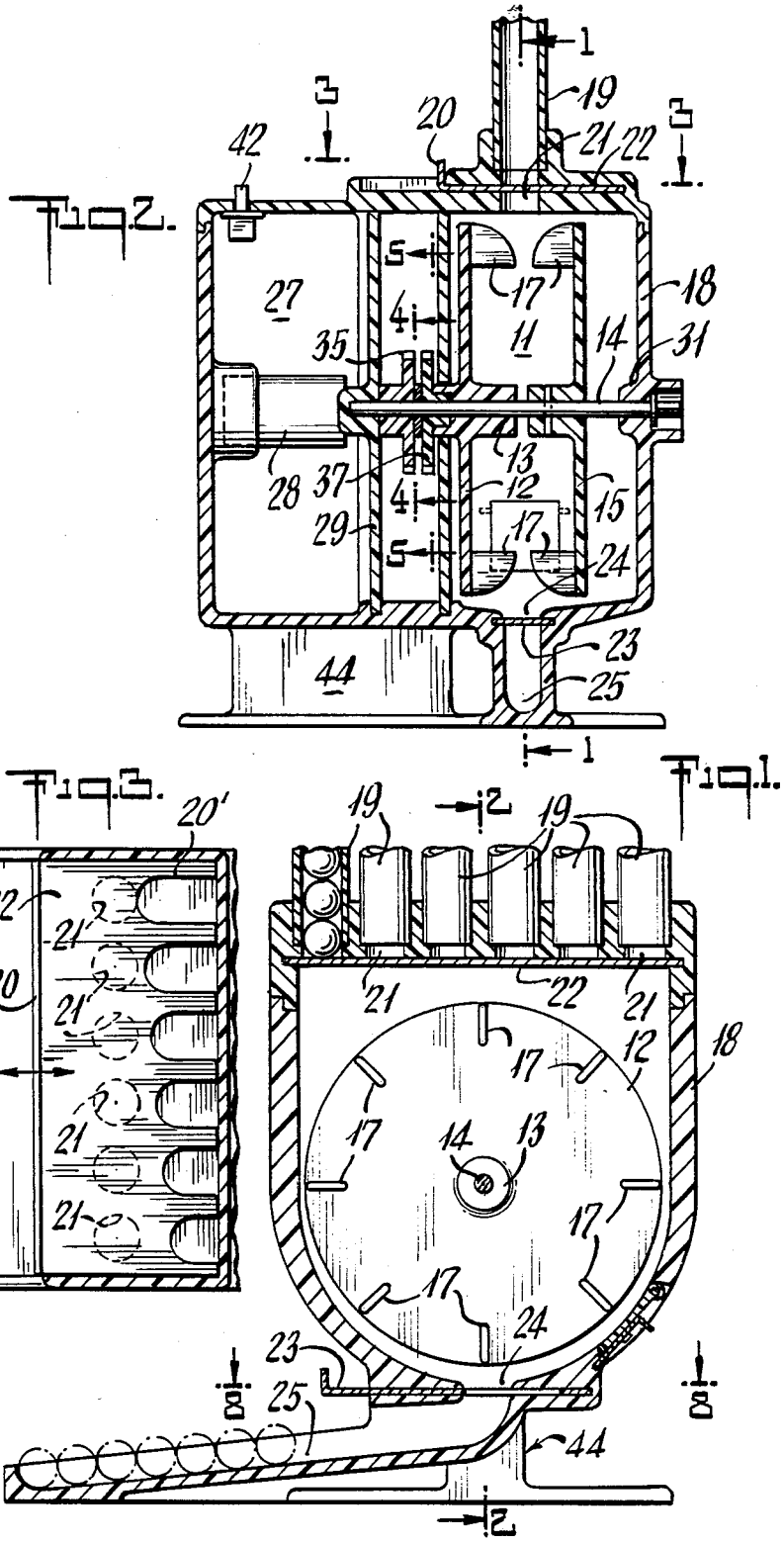
FIG. 1 is a vertical cross-sectional view along the plane 1—1 of FIG. 2 of a preferred embodiment of the lottery machine of this invention.
FIG. 2 is a vertical cross-sectional view of the machine taken along the plane 2—2 of FIG. 1.
FIG. 3 is a horizontal sectional view of only the inlet slide portion of the machine of FIGS. 1 and 2 taken along the plane 3—3 of FIG. 2 illustrating a preferred embodiment of the slide or gate arrangement for admitting balls to the mixing compartment.

With reference to FIG. 1 the lottery machine comprises a rotatable disk 12 mounted on hollow shaft 13 that is concentric with inner shaft 14 to which a second rotatable disk 15 (shown in FIG. 2) is attached. Desirably, to promote thorough agitation and mixing of balls in compartment 11, the lateral walls 16 are to a large extent cylindrical. Disks 12, 15 have several circumferentially spaced agitator elements or blades 17 attached to the opposed faces of disks 12, 15 to stir up the balls in mixing compartment 11. At least front wall 18 (FIG. 2) and preferably also side walls 16 of compartment 11 are formed of transparent materials, e.g. clear plastic.

Hopper means 19 for holding a predetermined multiplicity of indicia marked balls at the start of a game is positioned above mixing compartment 11 and may take various forms. The illustrated hopper is made up of a row of six tubes 19, each dimensioned to hold loosely a column of the game balls. Tubes 19, preferably made of clear plastic or glass, are open at both ends except that a movable slide 20 between the bottom ends of tubes 19 and apertures 21 in the top wall 22 of compartment 11 seals apertures 21 until the columns of balls in tubes 19 are to be released and dropped into compartment 11 by pulling slide 20 away from apertures 21. A preferred slide arrangement is illustrated in FIG. 3 wherein, as illustrated, the slide is provided with a series of U shaped openings 20' permitting as the slide is withdrawing, the balls to fall serially from tubes 19 into mixing chamber 11.

While disks 12, 15 are rotating in opposite directions and causing vigorous agitation and mixing of the balls in mixing compartment 11, a slide 23 extending across aperture 24 in the bottom of compartment 11 can be withdrawn when desired to let a random ball discharge and roll down chute 25. Aperture 24 will permit only one ball to pass therethrough. Slide 23 should be promptly pushed backed to seal aperture 24 as soon as a ball has dropped into chute 25 unless it is desired to have a predetermined number of balls drop into chute 25 in rapid succession when the further discharge of balls from compartment is stopped by moving slide 23 across aperture 24.

Figure 6:
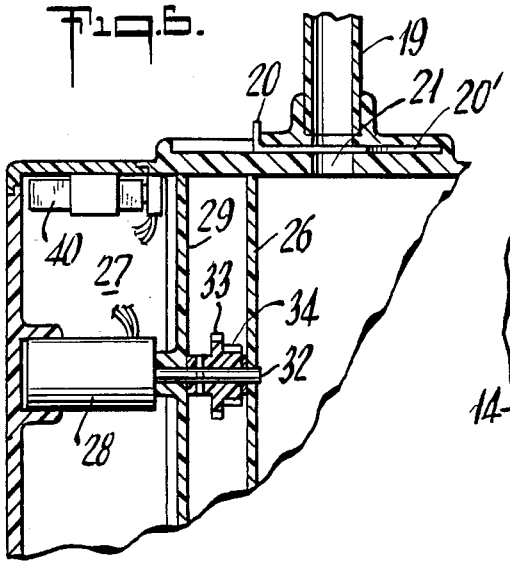
FIG. 6 is a partial vertical cross-sectional view taken along the plane 6—6 of FIG. 4.
Figure 7:
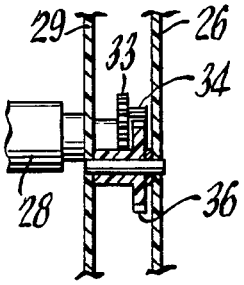
FIG. 7 is a partial vertical cross-sectional vie taken along the plane 7—7 of FIG. 5.
Figure 5:
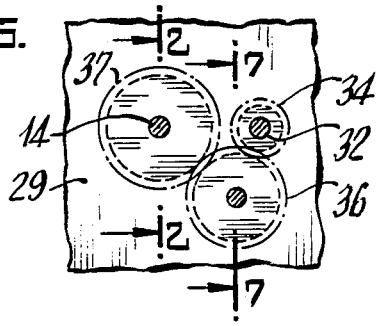
FIG. 5 is a simplified, diagrammatic representation of the electric motor and the remainder of the gear train taken along the plane 5—5 of FIG. 2.

With reference to FIG. 2, the mixing compartment 11, disks 12, 15, hopper tubes 19 and discharge chute 25 have already been described. Partition 26 forms an inner wall of compartment 11, separating the mixing compartment from the gear train and motor compartment 27 in which electric motor 28 is housed. Support wall 29 spaced from, and parallel to, partition 26 is preferably provided in the motor compartment 27 to provide support for shaft 14 which has one end in journal 30 held by wall 29 and its other end in journal 31 held by front wall 18. The gear train which transmits the rotary power of electric motor 28 to shaft 14 is positioned between partition 26 and support wall 29 as is more clearly illustrated in FIGS. 6 and 7.

Shaft 32 of motor 28 or an extension thereof passes through an opening in wall 29 and has first gear 33 and second gear 34 mounted thereon. Third gear 35 mounted on inner shaft 14 meshes with first gear 33. Idler gear 36 meshes with both second gear 34 and fourth gear 37 which is mounted on hollow shaft 13.

Figure 4:
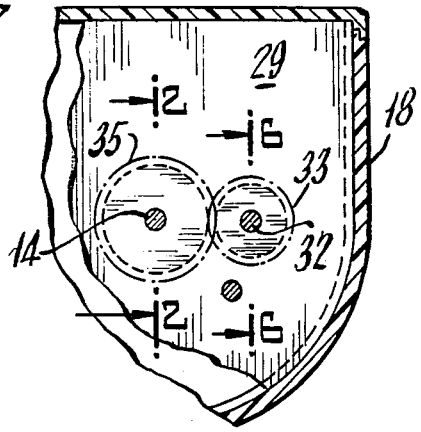
FIG. 4 is a partial cross-sectional view taken along the plane 4—4 of FIG. 2 illustrating the arrangement of the motor and part of the gear train.

In FIG. 4, motor shaft 32 is assumed to rotate clockwise. Thus, gears 33 and 34 on shaft 32 also rotate clockwise and cause counterclockwise rotation of meshing gears 35 and 36. The counterclockwise rotation of gear 35 is transmitted by inner shaft 14 to outer disk 15, while the same rotation of idler gear 36 causes meshing gear 37 to rotate clockwise. Inasmuch as gear 37 is mounted on hollows shaft or hub 13 to which inner disk 12 is attached, all three elements rotate clockwise. Regardless of direction of rotation of motor shaft 32, disks 12 and 15 will be rotated in opposite directions to ensure vigorous agitation and mixing of the balls in the mixing compartment 11. It may be desirable in some instances to use an electric motor that can be operated with clockwise or counterclockwise rotation so that, at will, the opposite rotations of disks 12 and 15 can be reversed.

Figure 8:
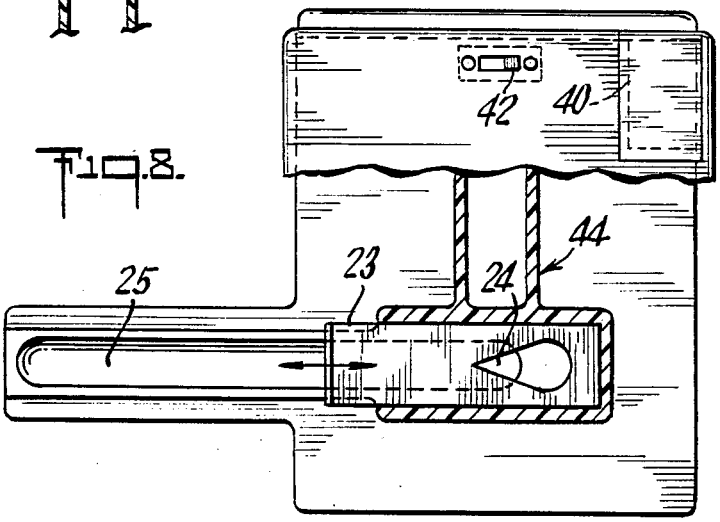
FIG. 8 is plan view of the machine, partially in cross-section, along the plane 8—8 of FIG. 1.

The motor 28 may be supplied by power from a battery or transformer 40 controlled by an externally mounted switch 42. The machine is provided with a suitable support base 44, as illustrated in FIGS. 1, 2 and 8.

Variations and modifications of the invention will be apparent to those skilled in the art. Other gear trains may be designed to cause opposite rotations of the two disks with blades that are mounted on concentric shafts. A fanciful design may be applied to the face of disk 12 that is visible through transparent disk 15 to produce pleasing visual effects when disk 12 is rotated. Blades or paddles 17 may be longer or shorter than those illustrated and may be a different positions radially on the disks. Slide 20 and/or slide 23 may be replaced by a trap door or other known device for controlling the passage of balls through an opening. The hopper may simply be a funnel and chute 25 may be replaced by a deep disk or tray. Accordingly, only such limitations should be imposed on the scope of the invention as are set forth in the appended claims.

I claim:

1. A lottery-type machine in which a multiplicity of balls of uniform diameter with varied indicia are mixed with agitation and from which a series of mixing compartment housing having a semicylindrical bottom and vertical end walls, a pair of parallel disks within said housing rotatable about a common horizontal axis and axially spaced from one another by a distance greater than the diameter of a ball, a plurality of circumferentially spaced agitator elements extending inwardly form the opposing faces of said disks arranged to permit free and independent rotation of the disks without interference with one another, means for rotating said disks in opposite directions, and means at the bottom of said mixing compartment for the random discharge of said balls one at a time.

2. A machine as defined in claim 1 comprising hopper means for holding said balls positioned above said mixing compartment and release means for dropping said balls from said hopper means into said mixing compartment.

3. A machine as defined in claim 2 wherein the hopper means comprises a plurality of transparent tubes, each of said tubes being adapted to hold a column of the balls.

4. A machine as defined in claim 2 wherein the discharge means is a movable slide arranged to permit sequential discharge of the balls from the tubes into the mixing compartment.

5. A machine as defined in claim 1 comprising a gear train associated with said motor, a drive shaft connected to said gear train and to one of said disks, a hollow drive shaft concentric with said drive shaft or hub and connected to said gear train and to the other of said disks, and gear means whereby the disks may be rotated in opposite directions.

6. A machine as defined in claim 1 wherein the means for rotating said disks comprises a battery powered electric motor.

7. A machine as defined in claim 1 wherein at least one end wall of the mixing compartment housing and at least one of said disks in transparent.

8. A machine as defined in claim 1 where the mixing compartment housing and the disks are transparent.

9. A machine as defined in claim 1 wherein the distance betwen disks is at least equal to the diameter of a single ball and not greater than two and one half times the diameter of a ball.

10. A lottery-type machine in which a multiplicity of balls of uniform diameter with varied indicia are mixed with agitation and from which a series of said balls are randomly discharged comprising a housing, a vertical partition dividing said housing into a first compartment and a second compartment, an electric motor mounted in said second comaprtment, a gear train associated with said motor to rotate in opposite directions two concentric shafts extending through an opening in said partition into said first compartment, a first disk mounted to rotate with the inner shaft of said concentric shafts in said first compartment, a second disk mounted to rotate with the outer shaft of said shafts in said first compartment, a plurality of circumferentially spaced blades on the face of said first disk opposite said second disk, a plurality of circumferentially spaced blades on the face of said second disk opposite said first disk, hopper means for holding said balls positioned above said first compartment, release means for dropping said balls from said hopper means into said first compartment, and discharge means at the bottom of said first compartment for the random discharge of said balls one at a time.

11. A machine as defined in claim 10 wherein the gear train comprises a first gear and a second gear mounted coaxially with the shaft of the electric motor, a third gear mounted on the inner shaft in mesh with said first gear, an idler gear in mesh with said second gear, and a fourth gear mounted on the outer shaft in mesh with said idler gear.

* * * * *